US008376035B2

(12) United States Patent
Howard et al.

(10) Patent No.: US 8,376,035 B2
(45) Date of Patent: Feb. 19, 2013

(54) PLATE-FIN HEAT EXCHANGER

(75) Inventors: Henry Edward Howard, Grand Island, NY (US); Richard John Jibb, Amherst, NY (US)

(73) Assignee: Praxair Technology, Inc., Danbury, CT (US)

( * ) Notice: Subject to any disclaimer, the term of this patent is extended or adjusted under 35 U.S.C. 154(b) by 1772 days.

(21) Appl. No.: 11/472,436

(22) Filed: Jun. 22, 2006

(65) Prior Publication Data

US 2007/0295027 A1 Dec. 27, 2007

(51) Int. Cl.
*F28F 3/00* (2006.01)
*F25J 3/00* (2006.01)

(52) U.S. Cl. ..... 165/166; 62/640; 165/140; 165/167

(58) Field of Classification Search ..... 62/643, 62/903; 135/166, 167, 140
See application file for complete search history.

(56) References Cited

U.S. PATENT DOCUMENTS

| | | | | |
|---|---|---|---|---|
| 3,372,453 | A | 3/1968 | Butt | 29/157.3 |
| 3,587,731 | A * | 6/1971 | Hays | 165/140 |
| 4,297,775 | A | 11/1981 | Butt et al. | 29/157.3 |
| 5,144,809 | A * | 9/1992 | Chevalier et al. | 165/166 |
| 5,231,835 | A | 8/1993 | Beddome et al. | 62/9 |
| 5,758,515 | A | 6/1998 | Howard | 62/646 |
| 6,044,902 | A * | 4/2000 | Pahade et al. | 165/166 |

* cited by examiner

*Primary Examiner* — John Pettitt
(74) *Attorney, Agent, or Firm* — David M. Rosenblum

(57) ABSTRACT

A plate-fin heat exchanger having a plurality of layers for indirectly exchanging heat between two or more fluids. The heat exchanger is provided with two sections and inlets and outlets to the sections to cause streams of the fluids to flow within the two sections parallel to the length of the heat exchanger between central locations and the ends of the heat exchanger. In such manner, the cross-sectional flow area of such a heat exchanger is greater than the heat exchanger in which the flow is from one end to the other end of the heat exchanger. This increase in cross-sectional flow area reduces the pressure drop within the heat exchanger.

3 Claims, 4 Drawing Sheets

PLATE-FIN HEAT EXCHANGER

FIELD OF THE INVENTION

The present invention relates to a plate-fin heat exchanger having a plurality of layers made up of plates and fins for indirectly exchanging heat between fluids flowing within the layers. More particularly, the present invention relates to such a plate-fin heat exchanger in which the layers are divided into two lengthwise extending sections so that streams of the fluids to be subjected to indirect heat exchange flow through both of the sections to increase the cross-sectional flow area within a layer.

BACKGROUND OF THE INVENTION

Plate-fin heat exchangers have particular applications in cryogenic plants that are used in natural gas processing and an air separation. Such heat exchangers are typically fabricated by fusing layers of aluminum flow passages having interior fining within a vacuum brazing oven. In a typical brazing operation, fins, parting sheets and end bars are stacked to form a core matrix. The core matrix is placed in the vacuum brazing oven where it is heated to the brazing temperature in a clean vacuum environment.

Small air separation plants, typically less than 400 tons per day oxygen utilize a plate-fin heat exchanger that has a single core matrix. However, for higher flows of heat exchange duty, the plate-fin heat exchanger is constructed from several of such cores that can be connected in series or in parallel.

Heat exchanger efficiency design is limited by the fact that each heat exchanger must be formed from individually brazed cores, which are in turn constrained in maximum cross-sectional flow areas because the brazing ovens are limited in size. Typically, brazing ovens have a length of between about 6.5 meters and about 10.0 meters and a width of between about 1.0 meters and about 2.0 meters. Consequently, the size and the design of a plate-fin heat exchanger is limited by the size of the furnace.

Typically, inlets and outlets for the layers contained within the plate-fin heat exchanger are positioned at opposite ends of the plate-fin heat exchanger. For a given heat transfer duty, the more compact the design of the plate-fin heat exchanger, the greater the fin density in order to provide an effective heat exchange area. For a given volume of the plate-fin heat exchanger, fin density can be increased to increase the effective heat exchange area. Fin density is defined as the number of individual fins extending from the top to the bottom of a flow passage of a layer per inch of flow width. Obviously using higher fin density will result in a higher heat transfer surface area per unit volume. The increase in surface area inevitably comes at the expense of more frictional pressure drop. It is also possible to increase the rate of heat transfer within a given heat exchanger by the use of fins which interrupt the flow or otherwise add turbulence to the fluid passing through the layer. In fact straight "plate fins" are rarely used as the primary heat transfer fin. Many such fin designs are available from plate-fin heat exchanger manufacturers—examples being wavy fins, perforated fins and serrated fins. All of these designs will provide higher rates of heat transfer at the expense of increased pressure drop.

In certain applications, such as air separation, pressure drop is a critical design consideration. In air separation, air is compressed and purified and thereafter the air is cooled to near its dew point prior to its introduction into a distillation column. The product and waste streams produced by the distillation column flow back through the heat exchanger to cool the incoming air. Obviously, if the fin density were increased and therefore the pressure drop, the air would have to be compressed at a much higher pressure to overcome the increase in pressure drop in both the incoming air stream and the product and waste streams. While the degree of increase in compression that may be required to overcome such increase pressure drop for the incoming air stream is not particularly critical, the amount of increase of the compression pressure of the incoming air required to overcome increased pressure drops for the product and waste streams can result in excessive power consumption.

In order to decrease the pressure drop for a particular plate-fin heat exchanger, it is known to increase the cross-sectional flow area of each of the layers. One known way to increase the cross-sectional flow area is to utilize inlets and outlets for the flow along the length of the plate-fin heat exchanger (i.e. the longest dimension of the plates from which the heat exchanger is formed) so that the liquid flows parallel to the width of the heat exchanger. Hence, the entire length of the heat exchanger forms part of the cross-sectional flow area to obtain a maximum increase in the flow area. In French patent application 2844040, the incoming air of an air separation plant that also produces nitrogen and oxygen is subjected to indirect heat exchange with the nitrogen and oxygen at alternating layers in which the inlet and outlets for these components are situated along the length of the heat-exchanger. The disadvantage of such a design is that the flow of each component must be distributed and redistributed across the length of the heat exchanger and such redistribution causes the flow to change direction and therefore incur a pressure drop. Additionally, since the flow is parallel with the width and as indicated above, the size of a plate-fin heat exchanger is limited by the size of the brazing, the fin density has to be increased to a level that is sufficient to obtain the required heat exchange duty for the heat exchanger. Thus, there does not exist a lot of flexibility in the design of such a heat exchanger.

As will be discussed hereinafter, the present invention provides a plate-fin heat exchanger in which the cross-sectional flow area is increased over a plate-fin heat exchanger of the prior art and that inherently possesses a great degree of design flexibility and application. Further advantages will become apparent from the following discussion.

SUMMARY OF THE INVENTION

The present invention provides a plate-fin heat exchanger having a plurality of layers including a first layer and a second layer for indirectly exchanging heat between a first fluid flowing through the first layer and a second fluid flowing through the second layer. Each of the first and the second layer are provided with fins. The plurality of layers are stacked one on the other to form a stack, thereby to define a height, a length and a width for the plate-fin heat exchanger, the length being longer than the width. Further, each of the first layer and the second layer has two sections and each of the two sections extend lengthwise, between the ends of the plate-fin heat exchanger towards a central location of the plate-fin heat exchanger situated between the ends. Each of the two sections has an inlet and an outlet located at opposite ends of each of the sections so that streams of the first fluid and the second fluid flow within the sections substantially parallel to the length of the plate-fin heat exchanger. As a result, the two sections provide a greater cross-sectional flow area to the first fluid and the second fluid than would otherwise have been provided had the inlets and outlets been positioned solely at the ends of the plate-fin heat exchanger.

Since the cross-sectional flow area is now increased, greater fin density can be employed than a plate-fin heat exchanger of the present invention to obtain the same pressure drop as that of a prior art plate-fin heat exchanger of similar size, namely, one having the same length, width and height while also possessing a greater heat transfer capacity due to the increase in fin density. Alternatively, a heat exchanger of the present invention could be designed to be more compact than a prior art plate-fin heat exchanger while having the same heat transfer capacity. A yet further possibility would be to retain the same fin density and outer dimension in a plate-fin heat exchanger of the present invention as compared with a prior art plate-fin heat exchanger to obtain a lower pressure drop for the fluids to be heat exchanged. Hence, there exists a greater design flexibility in a heat exchanger of the present invention over the prior art.

As will be discussed, the central location referred to above can be equidistant from the ends or off-center. In a plate-fin heat exchanger of the present invention the inlet and the outlet include headers in an orientation parallel to the height of the plate-fin heat exchanger. These headers can be situated at locations at least along one of the opposite sides of the plate-fin heat exchanger formed by the length thereof and at or adjacent to the ends of the plate-fin heat exchanger. In this regard, the first layer can be partitioned into the two sections thereof by a partition located at the central location and the two sections of the second layer section can be separated by a gap located at the central location. In such case, the headers can include a central header located at the central location and simultaneously in flow communication with the two sections of the first layer and two adjacent headers located adjacent the central location in flow communication with the two sections of the second layer.

A plate-fin heat exchanger can be employed in an air separation plant to cool a feed air stream through indirect heat exchange with a nitrogen-rich stream, a refrigerant stream and a waste stream, thereby to form a product stream, a fully warmed waste stream and a partly warmed waste stream, respectively. In such a heat exchanger, the first fluid and the second fluid are the feed air stream and the nitrogen-rich stream, respectively. The plurality of layers also include a third layer for the flow of the refrigerant stream and a fourth layer for the flow of the waste stream.

The two adjacent headers mentioned above can be a first pair of adjacent headers located adjacent the central header along one of the opposite sides of the plate-fin heat exchanger. The two sections of the third layer can be separated by a further gap and the two sections of the fourth layer can be spaced apart from one another. In such embodiment, the headers can further include a second pair of adjacent headers located opposite to the first pair of adjacent headers, along the other of the opposite sides of the plate-fin heat exchanger and in flow communication with the two sections of the third layer and a set of two pairs of outlying headers in flow communication with the two sections of the fourth layer. One of the outlying headers of each of the two pairs of outlying headers can be located on the one of the sides thereof, inwardly spaced from the ends of the plate-fin heat exchanger towards the central location and the other of the outlying headers of each of the two pairs of outlying headers can be located on the other of the opposite sides thereof, adjacent the ends of the plate-fin heat exchanger.

BRIEF DESCRIPTION OF THE DRAWINGS

While the specification concludes with claims distinctly pointing out the subject matter that Applicants regard as their invention, it is believed that the invention will be better understood when taken in connection with the accompanying drawings in which:

DETAILED DESCRIPTION

Figure 1:
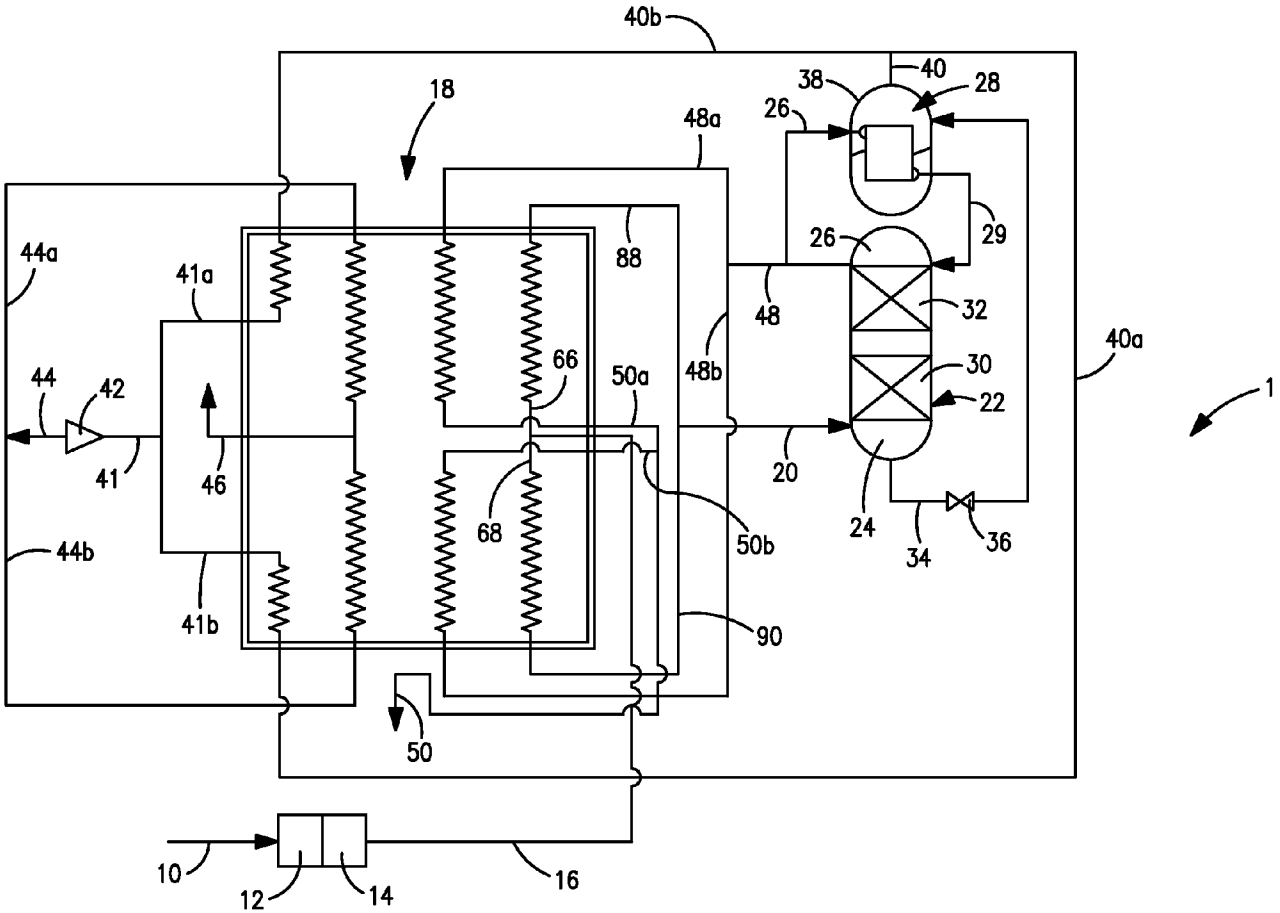
FIG. 1 is a schematic diagram of an air separation plant employing a plate-fin heat exchanger in accordance with the present invention.

With reference to FIG. 1 an air separation plant 1 is illustrated that is used to generate nitrogen. Such an air separation plant is known as a nitrogen generator.

A feed air stream 10 is compressed at a compression unit 12 that may be a multistage compressor having inter-stage cooling between stages. The compressed and purified air stream is then introduced into a purification unit 14 that is well known in the art. Prepurification unit 14 that can be a temperature swing adsorption unit having beds of alumina or molecular sieve type adsorbent operating out of phase to remove the lower boiling components of the air such as water and carbon dioxide. The resultant compressed and purified stream 16 is cooled to at or near its dew point in main heat exchanger 18 and introduced as a compressed, purified and cooled stream 20 into a distillation column 22.

The introduction of compressed, purified and cooled air stream 20 into distillation column 22 initiates the formation of an ascending vapor phase that becomes evermore rich in nitrogen as it ascends distillation column 22 to produce an oxygen-rich liquid column bottoms 24 and a nitrogen-rich column overhead 26. A first nitrogen-rich vapor stream 26 is condensed within a condenser 28 to return a liquid reflux stream 28 to distillation column 22. The return of liquid reflux stream 29 initiates the formation of a descending liquid phase 29 that becomes evermore rich in oxygen as it descends column 22.

The ascending vapor phase and the descending liquid phase are contacted by mass transfer contact elements 30 and 32 that can be a known structured packing, a random packing or known sieve trays.

An oxygen-rich column bottoms stream 34 is expanded to a lower temperature within an expansion valve 36 and then introduced into a shell 38 of condenser 28 for partial vaporization thereof against the liquefaction of the first nitrogen-rich vapor stream 26. The partially vaporized oxygen-rich liquid column bottoms produces a waste stream 40 that is partially warmed within main heat exchanger 18 and then introduced as a partly warmed waste stream 41 into a turboexpander 42 to produce a refrigerant stream 44 that is fully warmed within main heat exchanger 18 and discharged as a fully warmed waste stream 46. This action adds refrigeration to air separation plant 1 to maintain it at cryogenic temperatures. Part of the work of expansion can be employed in powering compression unit 12. A second nitrogen-rich vapor stream 48 is fully warmed within main heat exchanger 18 to produce a product nitrogen stream 50.

Thus, the incoming compressed and purified air stream 16 is fully cooled through indirect heat exchange with waste stream 40, the refrigeration stream 44 and the second nitrogen-rich vapor stream 48.

Figure 2:
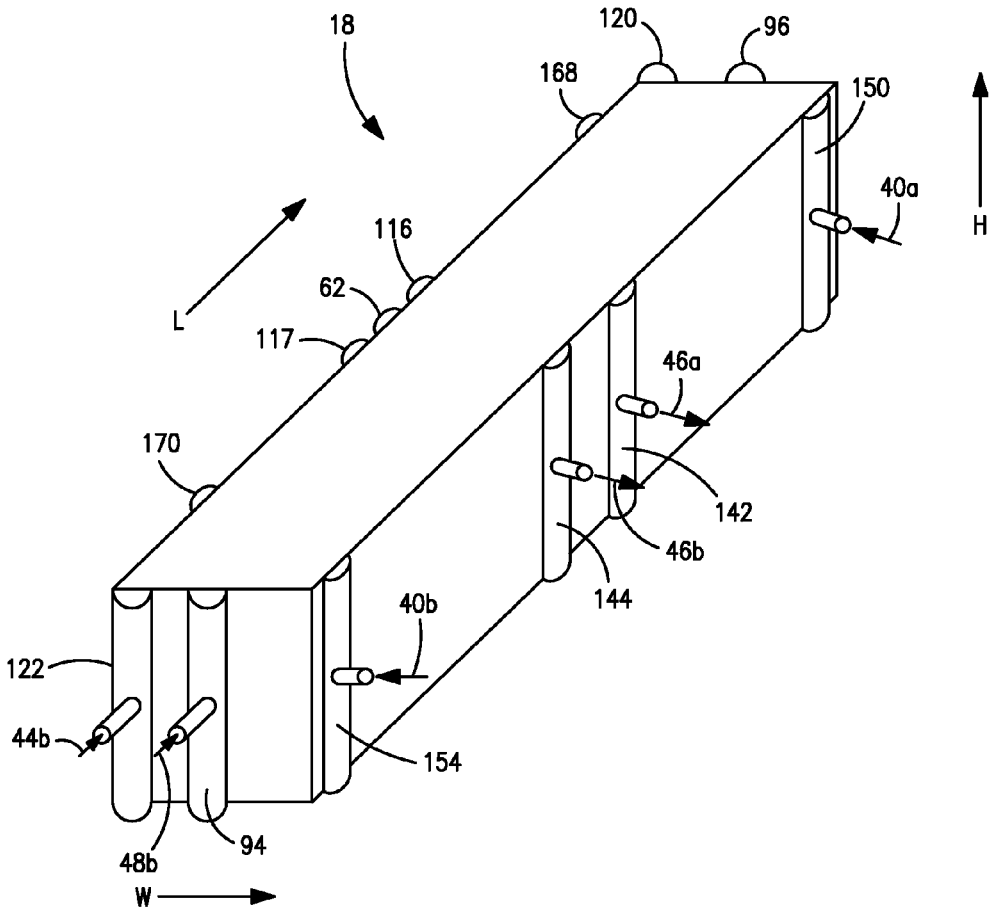
FIG. 2 is a perspective view of a plate-fin heat exchanger employed in FIG. 1.

With reference to FIG. 2, a plate-fin heat exchanger 18 is illustrated. Plate-fin heat exchanger 18 has layers stacked one on the other that are illustrated in FIGS. 3, 4, 5 and 6. Each of the layers is formed between two parting sheets and side bars and end bars separating the parting sheets. As illustrated, plate-fin heat exchanger 18 has a length "L", a width "W" and a height "H". The layers are stacked to form the height "H" of heat exchanger 18 and the outer periphery formed by the side and end bars defines the length "L" and the width "W". As illustrated the length "L" is longer than the width "W".

Figure 3:
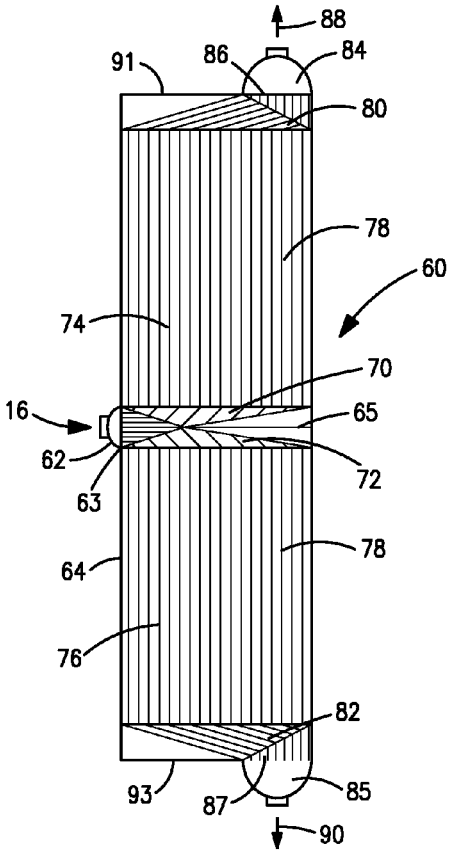
FIG. 3 is schematic, plan view of a layer of the plate-fin heat exchanger illustrated in FIG. 2 that is used for the passage of an incoming compressed and purified air stream to be rectified in the air separation plant shown in FIG. 1.

With additional reference to FIG. 3, compressed and purified air stream 16 is introduced into a first layer 60 of plate-fin heat exchanger 18 through an inlet provided by a central header 62 situated at a central location of plate-fin heat exchanger 18 between the ends thereof that is in flow communication with an opening 63 provided in a side bar 64 of first layer 60. First layer 60 is partitioned by a partition formed by a bar 65 which causes the compressed and purified air stream to be divided into subsidiary compressed and purified air streams 66 and 68 that can thus be seen in FIG. 1. The two streams are distributed by distributor fins 70 and 72 into two opposed sections 74 and 76 of first layer 60 having fins 78 to increase effective heat transfer area to which indirect heat exchange can take place and also to provide internal support within the plate-fin heat exchanger. The subsidiary compressed and purified air streams 66 and 68 flow outwardly from the central location provided by the inlet to layer 60. Flow is then redirected by provision of distribution fins 80 and 82 to an outlet provided by opposed outlet headers 84 and 85 in flow communication with openings 86 and 87 defined within end bars 91 and 93, respectively. Two compressed, purified and cooled air streams 88 and 90 are thereby discharged from headers 84 and 85 that combine to form compressed, purified and cooled air stream 20.

Figure 4:
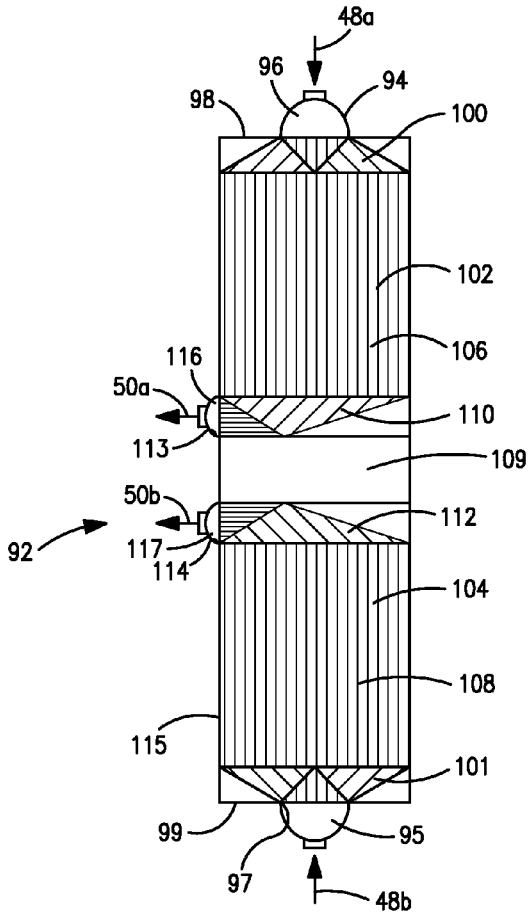
FIG. 4 is a schematic, plan view of a second layer that is used for providing a flow passage for a nitrogen-rich stream that is produced in the air separation plant illustrated in FIG. 1.

With additional reference to FIG. 4, a second layer 92 is illustrated that is designed to warm second nitrogen-rich stream 48 and thereby to produce the product stream 50. In order to accomplish this, nitrogen-rich stream 48 is divided into subsidiary nitrogen-rich streams 48*a* and 48*b*. Subsidiary nitrogen-rich streams 48*a* and 48*b* enter opposed inlets to second layer 92 located at the ends of plate-fin heat exchanger 18 that include headers 94 and 95 in flow communication with openings 96 and 97 provided within end bars 98 and 99, respectively. The two streams then flow into distribution fins 100 and 101 and are redirected to flow inwardly, along fins 102 and 106 provided within opposed sections 106 and 108 of second layer 92 separated by a gap 109. It is to be noted that the term "gap" as used herein and in the claims means a region that is not used to effect heat transfer. Such term does not necessarily mean a void. In fact, although not illustrated, any gap mentioned herein can be filled with fins and sealed along the sides by bars for structural support. The flow is then redirected by provision of distribution fins 110 and 112 to outlets provided by openings 113 and 114 defined within a side bar 115 of second layer 92 and headers 116 and 117 in flow communication with openings 113 and 114, respectively. Subsidiary product streams 50*a* and 50*b* are discharged from headers 116 and 117 and are combined to form product stream 50. As can best be seen in FIG. 2, headers 116 and 117 are located adjacent to the central header 62 on the same side of plate-fin heat exchanger 18.

Figure 5:
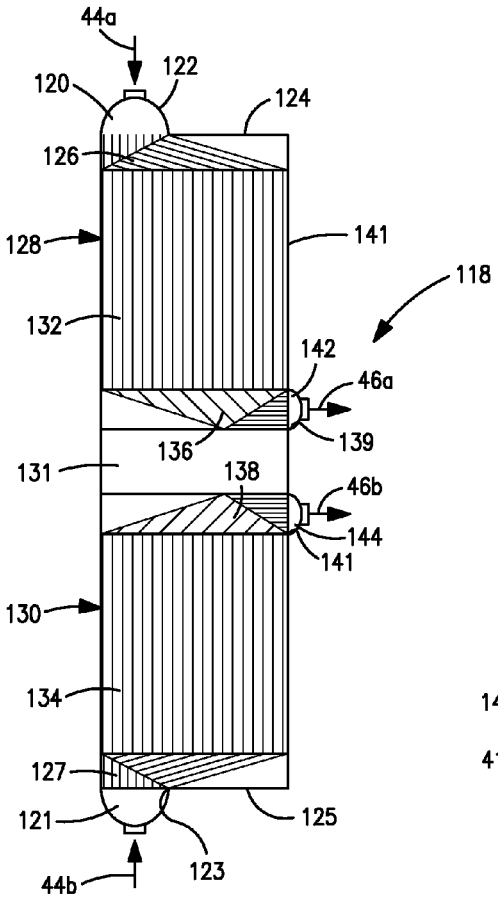
FIG. 5 is a schematic, plan view of a third layer utilized in the heat exchanger shown in FIG. 2 for providing a flow passage for a refrigerant stream.

With additional reference to FIG. 5, a third layer 118 is provided for flow of the refrigerant stream 44. Refrigerant stream 44 is split into subsidiary streams 44*a* and 44*b* that are introduced into opposed inlets formed at the end of third layer 118. Opposed inlets are formed by headers 120 and 121 in flow communication with openings 122 and 123 defined within end bars 124 and 125, respectively. Subsidiary streams 44*a* and 44*b* are then redirected by distribution fins 126 and 127 that produce flow of such streams in an inward direction towards the aforesaid central location within two opposed sections 128 and 130 separated by a gap 131. The two opposed sections 128 and 130 are provided with fins 132 and 134 to provide an enhanced heat transfer area and structural support. The two flows are then redirected by distribution fins 136 and 138 to outlets provided by openings 139 and 140 defined within side bar 141 and headers 142 and 144 in flow communication therewith. Subsidiary fully warmed waste streams 46*a* and 46*b* are discharged from headers 142 and 144; and as can best be seen in FIG. 1, are combined to form fully warmed waste stream 46. With brief reference to FIG. 2, headers 144 and 142 are situated at locations adjacent the central location and on a side of plate-fin heat exchanger 18 opposite to the side at which central header 62 and adjacent headers 116 and 117 are attached.

Figure 6:
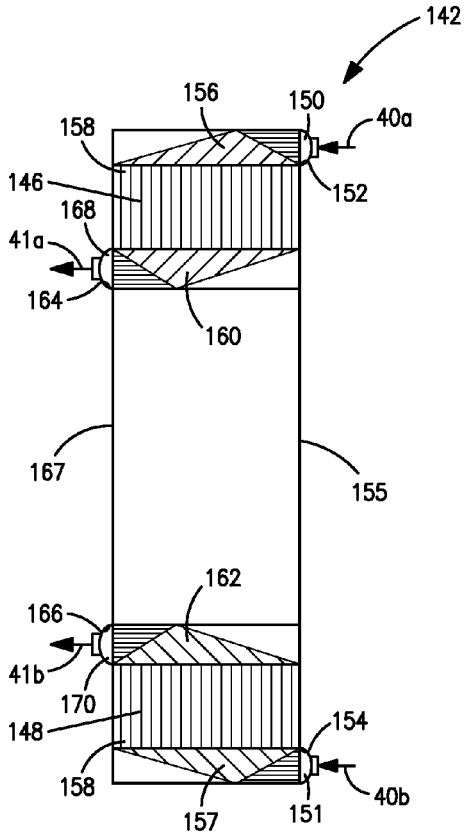
FIG. 6 is a schematic, plan view of a fourth layer employed in the heat exchanger illustrated in FIG. 2 that is utilized to provide a flow passage for a waste stream to be expanded in the air separation plant shown in FIG. 1 to refrigerate the plant.

With reference to FIG. 6, a fourth layer 142 is illustrated having two opposed sections 144 and 146. The waste stream 40 is divided into subsidiary waste steams 40*a* and 40*b* (see FIG. 1) that are in turn introduced into inlets formed by headers 150 and 151 and openings 152 and 154 defined within side bar 155. The flow is then inwardly directed within sections 114 and 146 by distribution fins 156 and 157. The flow of the subsidiary waste streams 40*a* and 40*b* partly warmed within the fourth layer 142 as they flow inwardly along fins 158. After having been partly warmed, waste streams 41*a* and 41*b* flow into distribution fins 160 and 162 to be redirected to outlets formed by openings 164 and 166 defined within side bar 167 and in flow communication with headers 168 and 170. As can best be seen in FIG. 2, headers 150 and 151 are located adjacent the ends of plate-fin heat exchanger 18 and on the same sides as headers 142 and 144. Headers 168 and 170 are located on the opposite side of plate-fin heat exchanger 18 in an outlying relationship to the central location and central header 62 and adjacent headers 116 and 117.

With reference again to FIG. 1, subsidiary partly warmed waste streams 41*a* and 41*b*, discharged from headers 168 and 170, are combined into partly warmed waste stream 41 and then introduced into turboexpanders 42.

In practice, the aforementioned layers will be patterned in the stack used in forming plate-fin heat exchanger 18 in a manner known by those skilled in the art. For example, for a nitrogen generator 1 illustrated in FIG. 1 the layers 60, 92, 118 and 142 will be included in approximately 120 layers having a repeating pattern that is designed in a manner well known in the art. For example, the pattern could be (given by the reference numbers of the layers alone) of 142, 60, 142, 60, 118, 60, 92, 60, 142, 60, 118, 60, 142, 60, 92, 60, 118, 60, 142, 60, 142. The important features of any pattern are that it is symmetrical (to prevent gross thermal gradients across the stack), and that the heat loads (energy transfer/unit time) for each individual layer are comparable (to prevent local excess or lack of energy available for transfer from hot to cold).

Naturally there are many layer patterns which could meet these criteria, in addition to the layer pattern used in the preceding example.

As can be appreciated, since all the flows are split so that they flow in two sections of each layer, the cross-sectional flow area per layer and therefore the entire cross-sectional flow area for heat exchanger 18 has been increased. As a result, there is a potentially lower pressure drop due to the increase cross-sectional flow area. The lower pressure drop allows the heat plate-fin heat exchanger 18 to be constructed in a conventional manner in a conventional size to produce the lower pressure drop or with a greater fin density to produce a greater heat transfer capacity. Additionally, plate-fin heat exchanger 18 might be made more compact with higher density fins to achieve a particular heat transfer duty that would normally require a longer heat exchanger.

Although the two opposed sections making up each layer are illustrated as being symmetrical given the central location being equidistant between the ends of the plate-fin heat exchanger 18, the central location could be off dead center. In such case, the unequal pressure drops produced in the opposed sections of each layer that would not be symmetrical could be compensated by varying the fin density. Hence, the term, "central location" as used herein and in the claims means any location between the ends of the plate-fin heat exchanger that can be at the geometric center thereof.

Additionally, although there exists counter current flow within heat exchanger 18 between the fluid to be cooled, namely compressed and purified air stream 16 and the streams to be warmed, for example, waste stream 44, second nitrogen-rich stream 48 and waste stream 40, this should not be seen as a limitation. For example, a plate-fin heat exchanger could be constructed in accordance with the present invention in which all flows were co-current or in the same direction. It is to be further pointed out that although a preferred embodiment has four different layers, it is possible to construct a heat exchanger in accordance with the present invention with only two layers, for example, layer 60 and layer 92 or more than four layers should there be more flows to be subjected to heat exchange.

While the invention has been described with reference to a preferred embodiment, as will occur to those skilled in the art, numerous, changes, additions and omissions can be made without departing from the spirit and the scope of the present invention that is recited in the appended claims.

We claim:

1. A plate-fin heat exchanger comprising: a plurality of layers including a first layer and a second layer for indirectly exchanging heat between a first fluid flowing through the first layer and a second fluid flowing through the second layer, each of the first and the second layer having fins; the plurality of layers stacked one on the other to form a stack, thereby to define a height, a length and a width for the plate-fin heat exchanger, the length being longer than the width; each of the first layer and the second layer having two sections extending along the length of the plate-fin heat exchanger with a central location of the plate-fin heat exchanger situated between the two sections; each of the two sections having an inlet and an outlet for introduction and discharge of the first fluid and the second fluid into and from the two sections of the first layer and the second layer, respectively; the inlet of one of the two sections connected to the inlet of the other of the two sections and the outlet of the one of the two sections connected to the outlet of the other of the two sections so that the first fluid and the second fluid divide into two subsidiary streams upon the introduction into the two sections of the first layer and the second layer, respectively, and combine upon the discharge from the two sections; and the inlet and the outlet of the one of the two sections and the inlet and the outlet of the other of the two sections positioned so that the two subsidiary streams flow parallel to the length of the plate-fin heat exchanger; wherein the central location is situated equidistantly from the ends of the plate-fin heat exchanger; wherein the plate-fin heat exchanger has opposite sides formed by the length of the plate-fin heat exchanger, the inlet and the outlet include headers in an orientation parallel to the height of the plate-fin heat exchanger and situated at locations at least along one of the opposite sides of the plate-fin heat exchanger at or adjacent to the ends of the plate-fin heat exchanger.

2. The plate-fin heat exchanger of claim 1, wherein:

the first layer is partitioned into the two sections thereof by a partition located at the central location;

the two sections of the second layer are separated by a gap located at the central location;

the headers include a central header located at the central location and simultaneously in flow communication with the two sections of the first layer, two adjacent headers located adjacent the central location in flow communication with the two sections of the second layer.

3. The plate-fin heat exchanger of claim 2, wherein:

the plate-fin heat exchanger is employed in an air separation plant to cool a feed air stream through indirect heat exchange with a nitrogen-rich stream, refrigerant stream and a waste stream, thereby to form a product stream, a fully warmed waste stream and a partly warmed waste stream, respectively;

the first fluid and the second fluid are the feed air stream and the nitrogen-rich stream, respectively;

the plurality of layers also include a third layer for the flow of the refrigerant stream and a fourth layer for the flow of the waste stream;

the two adjacent headers are a first pair of adjacent headers located adjacent the central header along one of the opposite sides of the plate-fin heat exchanger;

two sections of the third layer are separated by a further gap;

two sections of the fourth layer are spaced apart from one another; and the headers further include:

a second pair of adjacent headers located opposite to the first pair of adjacent headers, along the other of the opposite sides of the plate-fin heat exchanger and in flow communication with the two sections of the third layer; and a set of two pairs of outlying headers in flow communication with the two sections of the fourth layer, one of the outlying headers of each of the two pairs of outlying headers being located on the one of the sides thereof, inwardly spaced from the ends of the plate-fin heat exchanger towards the central location and the other of the outlying headers of each of the two pairs of outlying headers being located on the other of the opposite sides thereof, adjacent the ends of the plate-fin heat exchanger.

* * * * *